US007362299B2

(12) United States Patent
Hosotani

(10) Patent No.: US 7,362,299 B2
(45) Date of Patent: Apr. 22, 2008

(54) LIQUID CRYSTAL DISPLAY DEVICE, DRIVING CIRCUIT FOR THE SAME AND DRIVING METHOD FOR THE SAME

(75) Inventor: Yukihiko Hosotani, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 581 days.

(21) Appl. No.: 10/979,119

(22) Filed: Nov. 3, 2004

(65) Prior Publication Data

US 2005/0093806 A1 May 5, 2005

(30) Foreign Application Priority Data

Nov. 5, 2003 (JP) ..... 2003-375328

(51) Int. Cl.
*G09G 3/36* (2006.01)

(52) U.S. Cl. ..... 345/96; 345/99

(58) Field of Classification Search ..... 345/87–92, 345/94–95, 98–100, 204, 208, 209–214
See application file for complete search history.

(56) References Cited

U.S. PATENT DOCUMENTS 7,109,964 B2 * 9/2006 Pai ..... 345/96
7,142,203 B2 * 11/2006 Hiroki et al. ..... 345/209
2002/0089485 A1 7/2002 Youn
2004/0070581 A1 4/2004 Hiraki et al.

FOREIGN PATENT DOCUMENTS

JP 63-74036 4/1998
JP 2002-149117 5/2002

* cited by examiner

*Primary Examiner*—Richard Hjerpe
*Assistant Examiner*—Mansour M. Said
(74) *Attorney, Agent, or Firm*—Harness, Dickey & Pierce, PLC

(57) ABSTRACT

A look-up table stores a plurality of polarity pattern tables for setting the polarities of pixel voltages of pixel formation portions on a display screen. The plurality of polarity pattern tables are set such that when each of the polarity pattern tables is selected once, the number of positive polarities appearing at each of the pixel formation portions is the same as the number of negative polarities. The polarity instruction signal generation circuit selects one of the polarity pattern tables based on a random number that is outputted from a random number generation circuit, and outputs a polarity instruction signal based on the selected polarity pattern table. Then, the video signal line driving circuit outputs video signals such that a voltage with a polarity in accordance with the polarity instruction signal is applied to each of the pixel formation portions.

12 Claims, 13 Drawing Sheets

Fig.3

| | 1st | 2st | 3st | 4st | 5st | 6st | 7st | 8st | 9st | 10st | 11st | 12st | 13st | 14st | 15st | 16st | . . . |
|---|---|---|---|---|---|---|---|---|---|---|---|---|---|---|---|---|---|
| GL1 | + | + | − | − | + | − | − | + | − | + | − | + | − | + | − | + | . . . |
| GL2 | + | − | − | + | − | + | − | + | − | + | + | − | + | + | − | − | . . . |
| GL3 | − | + | + | − | + | − | + | − | + | − | − | + | − | − | + | + | . . . |
| GL4 | − | − | + | + | − | + | + | − | + | − | + | − | + | − | + | − | . . . |

POLARITY CHANGE AT EACH FRAME

Fig.4A

| | SL1 | SL2 | SL3 | SL4 |
|---|---|---|---|---|
| GL1 | + | − | + | − |
| GL2 | + | − | + | − |
| GL3 | − | + | − | + |
| GL4 | − | + | − | + |

FIRST PATTERN

Fig.4B

| | SL1 | SL2 | SL3 | SL4 |
|---|---|---|---|---|
| GL1 | − | + | − | + |
| GL2 | − | + | − | + |
| GL3 | + | − | + | − |
| GL4 | + | − | + | − |

SECOND PATTERN

Fig.4C

| | SL1 | SL2 | SL3 | SL4 |
|---|---|---|---|---|
| GL1 | + | − | + | − |
| GL2 | − | + | − | + |
| GL3 | + | − | + | − |
| GL4 | − | + | − | + |

THIRD PATTERN

Fig.4D

| | SL1 | SL2 | SL3 | SL4 |
|---|---|---|---|---|
| GL1 | − | + | − | + |
| GL2 | + | − | + | − |
| GL3 | − | + | − | + |
| GL4 | + | − | + | − |

FOURTH PATTERN

Fig.5

| | Bit 0 | Bit 1 | Bit 2 | Bit 3 |
|---|---|---|---|---|
| 00H | 1 | 1 | 0 | 0 |
| 01H | 1 | 0 | 1 | 0 |
| 02H | 0 | 0 | 1 | 1 |
| 03H | 0 | 1 | 0 | 1 |

Fig.6

| RANDOM NUMBER N | IDENTIFIER K |
|---|---|
| 0 | 00H |
| 1 | 01H |
| 2 | 02H |
| 3 | 03H |

| | 1st | 2st | 3st | 4st |
|---|---|---|---|---|
| GL1 | + | − | + | − |
| GL2 | − | + | + | − |
| GL3 | + | − | − | + |
| GL4 | − | + | − | + |

POLARITY CHANGE AT EACH FRAME

Fig.8A

| | SL1 | SL2 | SL3 | SL4 |
|---|---|---|---|---|
| GL1 | + | − | + | − |
| GL2 | − | + | − | + |
| GL3 | + | − | + | − |
| GL4 | − | + | − | + |

1st

Fig.8B

| | SL1 | SL2 | SL3 | SL4 |
|---|---|---|---|---|
| GL1 | − | + | − | + |
| GL2 | + | − | + | − |
| GL3 | − | + | − | + |
| GL4 | + | − | + | − |

2st

Fig.8C

| | SL1 | SL2 | SL3 | SL4 |
|---|---|---|---|---|
| GL1 | + | − | + | − |
| GL2 | + | − | + | − |
| GL3 | − | + | − | + |
| GL4 | − | + | − | + |

3st

Fig.8D

| | SL1 | SL2 | SL3 | SL4 |
|---|---|---|---|---|
| GL1 | − | + | − | + |
| GL2 | − | + | − | + |
| GL3 | + | − | + | − |
| GL4 | + | − | + | − |

4st

POLARITY CHANGE AT EACH FRAME

Fig.9

| | 1st | 2st | 3st | 4st | 5st | 6st | 7st | 8st | 9st | 10st | 11st | 12st | 13st | 14st | 15st | 16st | . . . |
|---|---|---|---|---|---|---|---|---|---|---|---|---|---|---|---|---|---|
| GL1 | + | + | − | − | + | − | − | + | − | + | − | + | − | + | − | + | . . . |
| GL2 | + | + | − | − | + | − | − | + | − | + | − | + | − | + | − | + | . . . |
| GL3 | + | − | − | + | − | + | − | + | − | + | + | − | + | + | − | − | . . . |
| GL4 | + | − | − | + | − | + | − | + | − | + | + | − | + | + | − | − | . . . |
| GL5 | − | + | + | − | + | − | + | − | + | − | − | + | − | − | + | + | . . . |
| GL6 | − | + | + | − | + | − | + | − | + | − | − | + | − | − | + | + | . . . |
| GL7 | − | − | + | + | − | + | + | − | + | − | + | − | + | − | + | − | . . . |
| GL8 | − | − | + | + | − | + | + | − | + | − | + | − | + | − | + | − | . . . |

POLARITY CHANGE AT EACH FRAME

Fig.10A

| | SL1 | SL2 | SL3 | SL4 |
|---|---|---|---|---|
| GL1 | + | + | + | + |
| GL2 | + | + | + | + |
| GL3 | − | − | − | − |
| GL4 | − | − | − | − |

1st

Fig.10B

| | SL1 | SL2 | SL3 | SL4 |
|---|---|---|---|---|
| GL1 | + | + | + | + |
| GL2 | − | − | − | − |
| GL3 | + | + | + | + |
| GL4 | − | − | − | − |

2st

Fig.10C

| | SL1 | SL2 | SL3 | SL4 |
|---|---|---|---|---|
| GL1 | − | − | − | − |
| GL2 | − | − | − | − |
| GL3 | + | + | + | + |
| GL4 | + | + | + | + |

3st

Fig.10D

| | SL1 | SL2 | SL3 | SL4 |
|---|---|---|---|---|
| GL1 | − | − | − | − |
| GL2 | + | + | + | + |
| GL3 | − | − | − | − |
| GL4 | + | + | + | + |

4st

POLARITY CHANGE AT EACH FRAME

Fig.11

| | Bit 0 | Bit 1 | Bit 2 | Bit 3 | Bit R |
|---|---|---|---|---|---|
| 00H | 1 | 1 | 0 | 0 | 1 |
| 01H | 1 | 0 | 1 | 0 | 0 |
| 02H | 0 | 0 | 1 | 1 | 1 |
| 03H | 0 | 1 | 0 | 1 | 0 |

Fig.12

| | 1st | 2st | 3st | 4st | 5st | 6st | 7st | 8st | 9st | 10st | 11st | 12st | 13st | 14st | 15st | 16st | . . . |
|---|---|---|---|---|---|---|---|---|---|---|---|---|---|---|---|---|---|
| GL1 | + | − | + | − | + | − | + | − | + | − | + | − | + | − | + | − | . . . |
| GL2 | − | + | − | + | − | + | − | + | − | + | − | + | − | + | − | + | . . . |
| GL3 | + | − | + | − | + | − | + | − | + | − | + | − | + | − | + | − | . . . |
| GL4 | − | + | − | + | − | + | − | + | − | + | − | + | − | + | − | + | . . . |

POLARITY CHANGE AT EACH FRAME

Fig.13

| | 1st | 2st | 3st | 4st | 5st | 6st | 7st | 8st | 9st | 10st | 11st | 12st | 13st | 14st | 15st | 16st | . . . |
|---|---|---|---|---|---|---|---|---|---|---|---|---|---|---|---|---|---|
| GL1 | + | − | + | − | + | − | + | − | + | − | + | − | + | − | + | − | . . . |
| GL2 | + | − | + | − | + | − | + | − | + | − | + | − | + | − | + | − | . . . |
| GL3 | − | + | − | + | − | + | − | + | − | + | − | + | − | + | − | + | . . . |
| GL4 | − | + | − | + | − | + | − | + | − | + | − | + | − | + | − | + | . . . |

POLARITY CHANGE AT EACH FRAME

Fig.14

PRIOR ART

| | 1st | 2st | 3st | 4st | 5st | 6st | 7st | 8st | 9st | 10st | 11st | 12st | 13st | 14st | 15st | 16st | ・・・ |
|---|---|---|---|---|---|---|---|---|---|---|---|---|---|---|---|---|---|
| GL1 | + | − | + | − | + | − | + | − | + | − | + | − | + | − | + | − | ・・・ |
| GL2 | − | + | − | + | + | − | + | − | − | + | − | + | + | − | + | − | ・・・ |
| GL3 | + | − | + | − | − | + | − | + | + | − | + | − | − | + | − | + | ・・・ |
| GL4 | − | + | − | + | − | + | − | + | − | + | − | + | − | + | − | + | ・・・ |

POLARITY CHANGE AT EACH FRAME

LIQUID CRYSTAL DISPLAY DEVICE, DRIVING CIRCUIT FOR THE SAME AND DRIVING METHOD FOR THE SAME

CROSS REFERENCE TO RELATED APPLICATIONS

This application claims priority under 35 U.S.C. § 119(a) upon Japanese Patent Application No. 2003-375328 titled "LIQUID CRYSTAL DISPLAY DEVICE, DRIVING CIRCUIT AND DRIVING METHOD FOR THE SAME," filed on Nov. 5, 2003, the entire content of which is hereby incorporated by reference.

BACKGROUND OF THE INVENTION

1. Field of the Invention

The present invention relates to driving circuits and driving methods of liquid crystal display devices, and in particular to the polarity inversion of voltages applied to pixels in active matrix liquid crystal display devices.

2. Description of the Related Art

Active matrix liquid crystal display devices provided with TFTs (thin film transistors) as switching elements have been known for several years. Such liquid crystal display devices are provided with a liquid crystal panel which includes two insulating substrates that are arranged opposite one another. On one substrate of the liquid crystal panel, scanning signal lines and video signal lines are arranged in a lattice, and TFTs are arranged near the intersections of the scanning signal lines and the video signal lines. Each of the TFTs has a drain electrode, a gate electrode branching off from the scanning signal lines, and a source electrode branching off from the video signal lines. The drain electrodes are connected to pixel electrodes that are arranged in a matrix on the substrate for forming an image. Also, the substrate on the other side of the liquid crystal panel is provided with an opposing electrode for applying a voltage between the pixel electrodes and the opposing electrode, across the liquid crystal layer. The individual pixels are formed by the pixel electrodes, the opposing electrode and the liquid crystal layer. It should be noted that, for the sake of convenience, regions forming single pixels are referred to as "pixel formation portions". Moreover, a voltage is applied to the pixel formation portions based on a video signal that the source electrodes of the TFTs receive from the video signal lines when the gate electrodes of the TFTs receive an active scanning signal from the scanning signal lines. Thus, the liquid crystal is driven, and the desired image is displayed on the screen.

Now, the liquid crystal has the property of degrading when a DC voltage is applied to it continuously. Therefore, an AC voltage is applied to the liquid crystal layer in the liquid crystal display device. This application of the AC voltage to the liquid crystal layer is realized by inverting the polarity of the voltage applied to each of the pixel formation portions at every single frame period, that is, by inverting at every single frame period the polarity of the voltage of the source electrode (video signal voltage) when taking the voltage of the opposing electrode as the reference. As technologies for realizing this, a driving method known as line inversion driving and a driving method known as dot inversion driving are known. It should be noted that in the following, the voltage applied to the pixel formation portions is referred to as "pixel voltage".

In line inversion driving, the polarity of the pixel voltage is inverted at every single frame period and at every predetermined number of signal scanning lines. For example, a driving method in which the polarity of the pixel voltage is inverted at every single frame period and at every two scanning signal lines is referred to as "2-line inversion driving". On the other hand, in dot inversion driving, the polarity of the pixel voltage is inverted at every single frame, and also the polarities of pixels that are adjacent in the horizontal direction are inverted in a single frame period. Driving method in which the polarity of the pixel voltage is inverted at every predetermined number of scanning signal lines can also be applied to dot inversion driving. For example, dot inversion driving in which the polarity of the pixel voltage is inverted at every two scanning signal lines is referred to as "2-line-dot inversion driving".

FIG. 12 is a polarity diagram illustrating the change of the polarities of the pixel voltages in 1-line inversion driving and in 1-line-dot inversion driving. FIG. 13 is a polarity diagram showing the change of the polarities of the pixel voltages in 2-line inversion driving and in 2-line-dot inversion driving. FIGS. 12 and 13 show the polarities of the pixel voltages that are applied, for each frame period, to the pixel formation portions at the intersection between the scanning signal lines from the first row to the fourth row and the video signal line of the first column. "GL1 to GL4" denotes the scanning signal lines. "Nr. 1 to Nr. 16" denotes the frame periods. "+" and "−" indicate the pixel voltage polarity. As shown in FIGS. 12 and 13, the polarity of the pixel voltage of each of the pixel formation portions is inverted at every single frame period. It should be noted that the difference between line inversion driving and dot inversion driving lies in whether, within one frame period, there is a polarity inversion of the pixel voltage among pixels that are adjacent in the horizontal direction on the display screen. Consequently, taking note of the individual pixel formation portions, for line inversion driving and dot inversion driving alike, the polarity of the pixel voltage at every frame period changes in the same manner.

With the above-described 1-line inversion driving, flickering can be perceived when white and gray are displayed alternately at every single scanning signal line, for example. The reason for this is that the polarities of the pixel voltages of all pixel formation portions of the scanning signal lines displaying gray become the same, and the flicker components are not averaged. Moreover, also in 2-line inversion driving, when white and gray are displayed alternately at every two scanning lines, flickering can be perceived for the same reason as in the case of 1-line inversion driving.

In order to solve this problem, JP 2002-149117A proposes a liquid crystal display device that switches between 1-line inversion driving and 2-line inversion driving at every predetermined number of frame periods. FIG. 14 is a polarity diagram showing the change of the polarities of the pixel voltages in this liquid crystal display device. As shown in FIG. 14, 1-line inversion driving is performed in the first to fourth frame periods, and 2-line inversion driving is performed in the fifth to eighth frame periods. Then, the same polarity change pattern as the change of polarities of pixel voltages in the first to eighth frame periods (in the following, the change of polarities of the pixel voltages in a plurality of frame periods is referred to as "polarity change pattern") is repeated from the ninth frame period onward. In accordance with this driving method, even if white and gray are displayed at every predetermined number of scanning signal lines, the polarities of the pixel voltages of all pixel formation portions in the scanning signal lines displaying gray will not be the same. Thus, the flickering components can be averaged, and flickering can be suppressed.

However, even with a driving method as described above, the polarities of the pixel voltages of the pixel formation portions change in a regular fashion. Therefore, there are image patterns known as "killer patterns", in which the polarity change patterns themselves can be perceived as flickering. Thus, the degradiation of the display quality could not be prevented.

SUMMARY OF THE INVENTION

It is thus an object of the present invention to provide a liquid crystal display device with which flickering caused by the polarity change pattern itself can be suppressed and a favorable display quality can be attained, as well as a driving circuit and a driving method for the same.

According to a first aspect of the present invention, a driving circuit of an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected, comprises:

a polarity instruction circuit for outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative;

a scanning signal line driving circuit for selectively driving the plurality of scanning signal lines; and a video signal line driving circuit for supplying the plurality of video signals generated based on the polarity instruction signal to the plurality of video signal lines.

With this configuration, for every predetermined number of frame periods, the number of times that the polarity of the pixel voltage of each of the pixel formation portions becomes positive is the same as the number of times that it becomes negative. Thus, the polarity of the pixel voltage of each of the pixel formation portions does not display a preference towards positive or negative. Therefore, it is possible to suppress flickering without deteriorating the liquid crystal, with a configuration in which the polarity of the pixel voltage of each of the pixel formation portions is changed without regularity.

In this driving circuit, it is preferable that the polarity instruction circuit comprises different polarity pattern tables indicating, for a plurality of the pixel formation portions respectively corresponding to the intersections of a predetermined number of scanning signal lines and the plurality of video signal lines, whether the polarity of the voltage to be applied is positive or negative, the number of the polarity pattern tables being the same as the number of frame periods included in the polarity equilibrium period;

that each of the polarity pattern tables is selected by the polarity instruction circuit once in each polarity equilibrium period, in an irregular order; and that the polarity instruction signal is generated by the polarity instruction circuit based on the selected polarity pattern table, so as to determine the polarity of the plurality of pixel formation portions.

With this configuration, a plurality of polarity pattern tables indicating the polarities of the pixel voltages for all of the pixel formation portions within one block into which a predetermined number of scanning signal lines have been grouped together are stored in advance. Then, voltages are applied to the pixel formation portions, in accordance with polarity pattern tables that are selected irregularly. Thus, by repeating, in the direction in which the video signal lines extend on the display screen, the same polarity pattern as the polarity pattern represented by the polarity pattern table for a given block, it is possible to let the polarities of the pixel voltages of all pixel formation portions on the display screen change without regularity. Moreover, within a predetermined period, the polarity pattern tables are selected once each. Thus, the polarities of the pixel voltages of all pixel formation portions do not display a preference towards positive or negative. Therefore, it is easy to suppress flickering without deteriorating the liquid crystal.

In this driving circuit, it is preferable that the polarity pattern tables are set such that, among the plurality of pixel formation portions, at least two pixel formation portions in which the polarities of the voltages to be applied are the same are consecutive in a direction in which the video signal lines extend.

With this configuration, the polarities of pixel voltages of a plurality of pixel formation portions that are consecutive in a direction in which the video signal lines extend on the display screen are inverted at intervals of the plurality of pixel formatin portions with the same polarity. Thus, insufficient charging of the pixel capacities, which may occur when the polarities of the pixel voltages are inverted at every line, can be prevented, and also the power consumption is reduced.

According to another aspect of the present invention, an active matrix liquid crystal display device comprises:

a plurality of video signal lines for transmitting a plurality of video signals representing an image to be displayed, and a plurality of scanning signal lines intersecting the plurality of video signal lines;

a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected;

a polarity instruction circuit for outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative;

a scanning signal line driving circuit for selectively driving the plurality of scanning signal lines; and a video signal line driving circuit for supplying the plurality of video signals generated based on the polarity instruction signal to the plurality of video signal lines.

According to yet a further aspect of the present invention, a method for driving an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected, comprises:

a polarity instruction step of outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative; and a video signal generation step of generating the plurality of video signals generated based on the polarity instruction signal.

These and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a polarity change diagram showing the change of the polarities of the pixel voltages in this embodiment.

FIGS. 4A to 4D are polarity diagrams showing the polarities of the pixel formation portions within one block for different frame periods in this embodiment.

FIG. 5 is a diagram of a look-up table according to this embodiment.

FIG. 6 is a diagram showing how random numbers and identifiers of the look-up table in this embodiment are correlated.

FIG. 8A is a polarity diagram showing the polarities of the pixel formation portions in the first frame period within one polarity equilibrium period in this embodiment.

FIG. 8B is a polarity diagram showing the polarities of the pixel formation portions in the second frame period within one polarity equilibrium period in this embodiment.

FIG. 8C is a polarity diagram showing the polarities of the pixel formation portions in the third frame period within one polarity equilibrium period in this embodiment.

FIG. 8D is a polarity diagram showing the polarities of the pixel formation portions in the fourth frame period within one polarity equilibrium period in this embodiment.

FIG. 9 is a polarity change diagram showing the change of the polarities of the pixel voltages in a modified example of the embodiment of the present invention.

FIG. 10A is a polarity diagram showing the polarity of the pixel formation portions in the first frame period within one polarity equilibrium period in a second modified example of the embodiment of the present invention.

FIG. 10B is a polarity diagram showing the polarity of the pixel formation portions in the second frame period within one polarity equilibrium period in a second modified example of the embodiment of the present invention.

FIG. 10C is a polarity diagram showing the polarity of the pixel formation portions in the third frame period within one polarity equilibrium period in a second modified example of the embodiment of the present invention.

FIG. 10D is a polarity diagram showing the polarity of the pixel formation portions in the fourth frame period within one polarity equilibrium period in a second modified example of the embodiment of the present invention.

FIG. 11 is a diagram showing a look-up table according to a third modified example of the embodiment of the present invention.

FIG. 12 is a polarity change diagram showing the change of the polarities of the pixel voltages in 1-line inversion driving and 1-line dot inversion driving.

FIG. 13 is a polarity change diagram showing the change of the polarities of the pixel voltages in 2-line inversion driving and 2-line dot inversion driving.

FIG. 14 is a polarity change diagram showing the change of the polarities of the pixel voltages in a driving method switching between 1-line inversion driving and 2-line inversion driving.

DESCRIPTION OF THE PREFERRED EMBODIMENTS

The following is a description of embodiments of the present invention, with reference to the accompanying drawings.

1. Overall Configuration of Liquid Crystal Display Device

Figure 1:
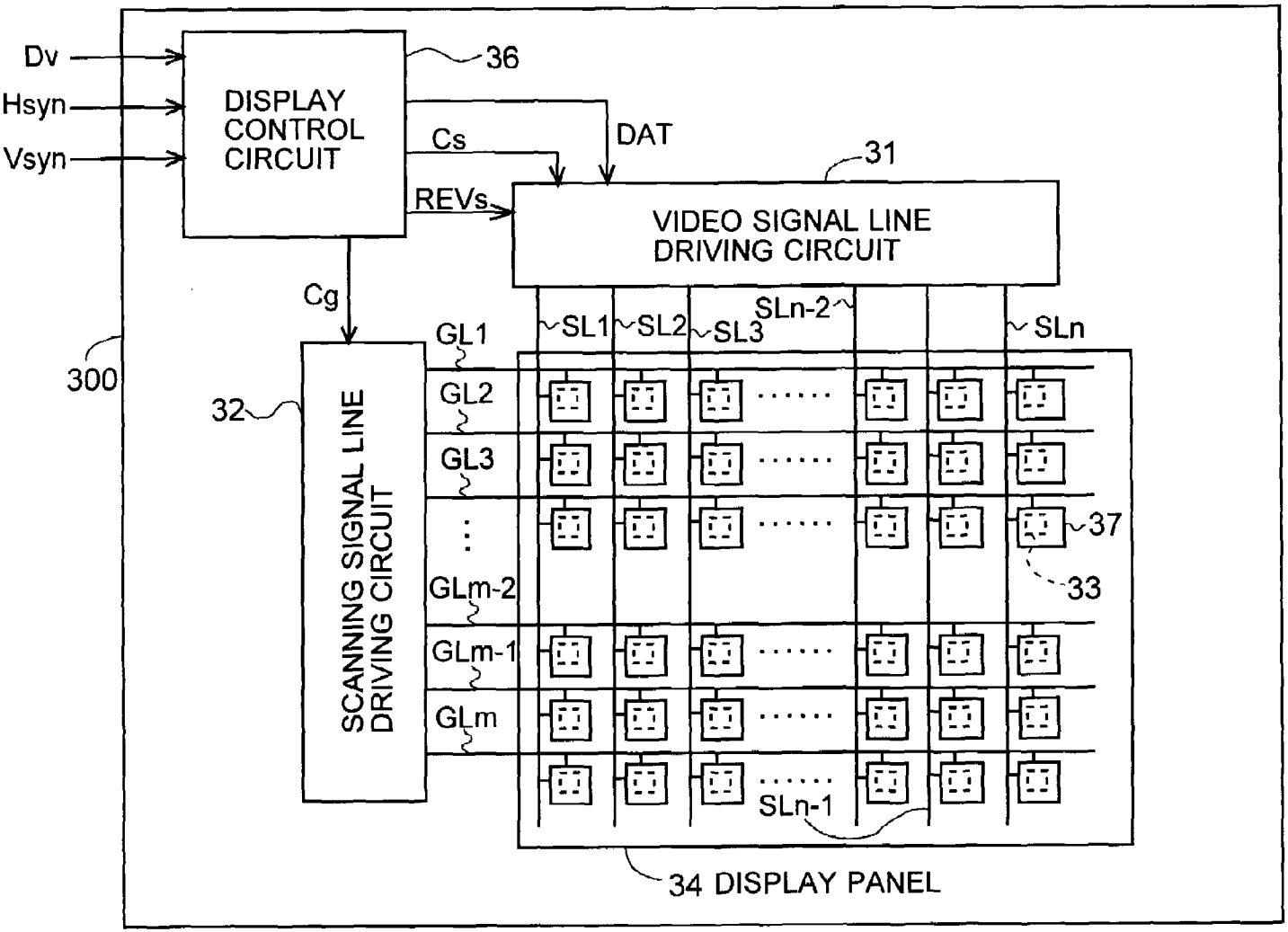
FIG. 1 is a block diagram showing the overall configuration of a liquid crystal display device according to an embodiment of the present invention.

FIG. 1 is a block diagram showing the overall configuration of a liquid crystal display device 300 according to an embodiment of the present invention. This liquid crystal display device 300 includes a video signal line driving circuit 31, a scanning signal line driving circuit 32, a display panel 34, and a display control circuit 36. In the display panel 34, a plurality of scanning signal lines GL1 to GLm and a plurality of video signal lines SL1 to SLn are disposed in a lattice arrangement. Display elements 33 are provided in correspondence with intersections of the plurality of scanning signal lines GL1 to GLm and the video signal lines SL1 to SLn. Single pixel formation portions 37 are constituted by the individual display elements 33 and a liquid crystal layer, for example. Each of the pixel formation portions 37 is provided with a pixel capacitance, which holds a voltage representing the pixel value of that pixel. The scanning signal lines GL1 to GLm are connected to a scanning signal line driving circuit 32, whereas the video signal lines SL1 to SLn are connected to a video signal line driving circuit 31. It should be noted that the display device 300 that is described here is provided with m scanning signal lines and n video signal lines.

The display control circuit 36 receives image data Dv representing image information, as well as a horizontal synchronization signal Hsyn and a vertical synchronization signal Vsyn for timing from a signal source arranged outside of the liquid crystal display device 300, and outputs a gate control signal Cg for controlling the scanning signal line driving circuit 32, a source control signal Cs for controlling the video signal line driving circuit 31, a video signal DAT representing image information, and a polarity instruction signal REVs for giving instructions indicating the polarity of the pixel voltages. The gate control signal Cg includes, for example, a timing signal for supplying an active scanning signal sequentially to each of the scanning signal lines GL1 to GLm. The source control signal Cs includes, for example, a timing signal for supplying a video signal to each of the video signal lines SL1 to SLn. The scanning signal line driving circuit 32 receives the gate control signal Cg that is outputted by the display control circuit 36, and outputs a scanning signal to each of the scanning signal lines GL1 to GLm. The video signal line driving circuit 31 receives the video signal DAT, the source control signal Cs and the polarity instruction signal REVs outputted by the display control circuit 36, and outputs a driving video signal for displaying the image on the display panel 34 to each of the video signal lines SL1 to SLn. Thus, by outputting scanning signals from the scanning signal line driving circuit 32 and outputting driving video signals from the video signal line driving circuit 31, a voltage corresponding to the driving video signal is applied to each of the pixel formation portions 37, and the desired image is displayed on the display panel 34.

Figure 2:
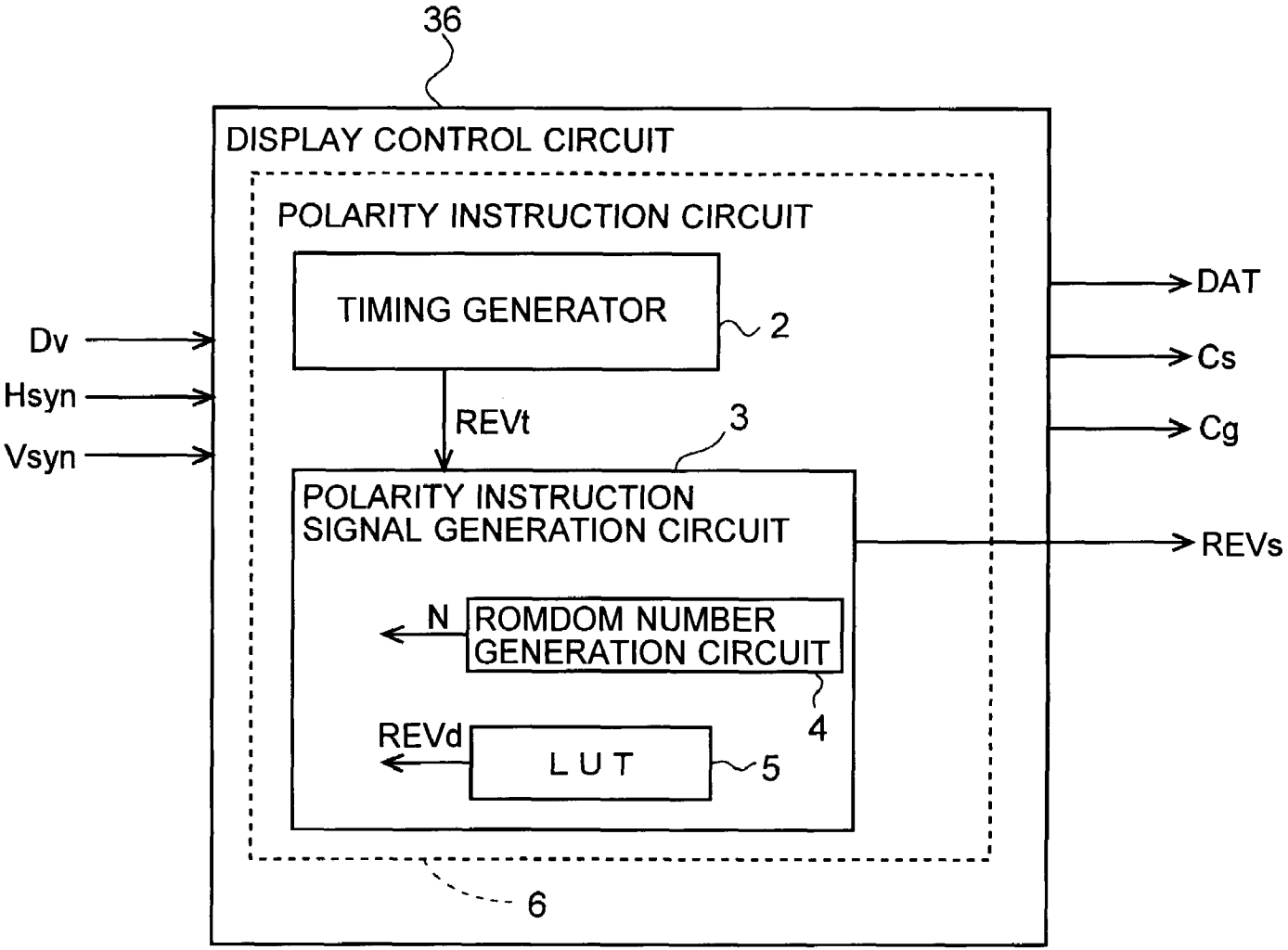
FIG. 2 is a block diagram illustrating the detailed configuration of a display control circuit according to this embodiment.

FIG. 2 is a block diagram illustrating the detailed configuration of the display control circuit 36 according to the present embodiment. This display control circuit 36 includes a timing generator 2 and a polarity instruction signal generation circuit 3. The polarity instruction signal generation circuit 3 further includes a random number generation circuit 4 and a look-up table 5. The look-up table 5 stores polarity instruction bit data REVd indicating the polarities of the voltages applied to the pixel formation portions 37. The timing generator 2 outputs a polarity instruction timing signal REVt at predetermined periods corresponding to one frame period. The polarity instruction signal generation circuit 3 receives the polarity instruction timing signal REVt, reads in polarity instruction bit data REVd from the look-up table 5 in accordance with a random number N that is outputted by the random number generation circuit 4, and outputs a polarity instruction signal REVs based on this polarity instruction bit data REVd. The operation of the polarity instruction signal generation circuit 3 is explained in detail further below. Moreover, a polarity instruction circuit 6 is realized by the timing generator 2 and the polarity instruction signal generation circuit 3.

2. Polarity Change Pattern and Polarity Pattern

Next, a polarity change pattern of pixel voltages according to the present embodiment is explained with reference to FIG. 3. In FIG. 3, rows are represented by the reference symbols GL1 to GLm indicating the scanning signal lines. Moreover, for the sake of convenience, FIG. 3 shows the polarities of the pixel voltages of the pixel formation portions 37 that are arranged in correspondence with the intersections between the first through fourth scanning signal lines GL1 to GL4 and the first video signal line SL1. From the fifth row onward, the same polarity change pattern as that of the first through fourth rows is repeated. It should be noted that in the current explanations, the size of one block is four rows, but the size of one block may also be three rows or less, or five rows or more. In the following, for explanations of the pixel formation portion 37 arranged in correspondence with the intersection of the scanning signal line GLj of the j-th row and the video signal line SL1 of the first column, the notation "j-th pixel voltage" or "j-th polarity" or the like is used (j=1,2, . . . ,m).

As shown in FIG. 3, during the first frame period, the polarity of the first scanning signal line GL1 and the second scanning signal line GL2 is positive, whereas the polarity of the third scanning signal line GL3 and the fourth scanning signal line GL4 is negative. Moreover, during the second frame period, the polarity of the first scanning signal line GL1 and the third scanning signal line GL3 is positive, whereas the polarity of the second scanning signal line GL2 and the fourth scanning signal line GL4 is negative.

Let us now take note of the first to fourth frame periods. During this period, the polarity of the first scanning signal line GL1 is positive in the first and the second frame periods, and is negative in the third and the fourth frame periods. Consequently, there are two frame periods in which its polarity is positive and two frame periods in which its polarity is negative. The polarity of the second scanning signal line GL2 is positive in the first and the fourth frame periods, and is negative in the second and the third frame periods. Consequently, as in the case of the first scanning line GL1, there are two frame periods in which its polarity is positive and two frame periods in which its polarity is negative. Also for the third scanning line GL3 and the fourth scanning line GL4, there are two frame periods each in which the polarity is positive and two frame periods each in which the polarity is negative. Thus, for all rows (scanning signal lines), there are two frame periods each in which the polarity is positive and two frame periods each in which the polarity is negative.

Next, let us take note of the fifth to eighth frame periods. During this period, the polarity of the first scanning signal line GL1 is positive in the fifth and the eighth frame periods, and is negative in the sixth and the seventh frame periods. Consequently, there are two frame periods in which its polarity is positive and two frame periods in which its polarity is negative. Similarly, also for the second to fourth scanning lines GL2 to GL4, there are two frame periods each in which the polarity is positive and two frame periods each in which the polarity is negative.

Furthermore, also for the ninth to twelfth frame periods and for the thirteenth to sixteenth frame periods, there are, for each of the rows (signal scanning lines), two frame periods in which the polarity is positive and two frame periods in which the polarity is negative.

Next, let us take note of the polarity change pattern of the first scanning line GL1. In the first to fourth frame periods, the polarity change pattern of the first scanning line GL1 is "+, +, −, −". In the fifth to eighth frame periods, the polarity change pattern of the first scanning line GL1 is "+, −, −, +". In the ninth to twelfth frame periods, the polarity change pattern of the first scanning line GL1 is "−, +, −, +". And in the thirteenth to sixteenth frame periods, the polarity change pattern of the first scanning line GL1 is "−, +, −, +". Thus, there is no regularity in the order of the occurrence of "+" and "−". Similarly, also in the polarity change pattern of the second scanning line GL2, the third scanning line GL3 and the fourth scanning line GL4, there is no regularity in the order of the occurrence of "+" and "−".

Thus, in this embodiment, among every four frame periods, there are two frame periods each in which the polarity of each of the pixel formation portions 37 becomes positive and two frame periods each in which the polarity of each of the pixel formation portions 37 becomes negative. However, the polarity change patterns of the pixel formation portions 37 show no regularity.

The following is a description of the polarity settings for all of the pixel formation portions 37 in the display screen during a given frame period. In this embodiment, four scanning signal lines are taken as one block, and the polarities of the pixel formation portions 37 included in this block are set. Moreover, the same polarities as the polarities specified for one block, are repeated in the direction in which the video signal lines extend on the display screen. Thus, the polarities of all the pixel formation portions 37 on the display screen are set. Consequently, the order of the polarities from the first row to the fourth row is the same as the order of the polarities from the fifth row to the eighth row. Similarly, the order of the polarities from the first row to the fourth row is also the same as the order of the polarities from the ninth row to the twelfth row. The same is true from the thirteenth row onward. FIGS. 4A to 4D are polarity diagrams showing the polarities of the pixel formation portions 37 within one block. FIGS. 4A to 4D show polarity diagrams for different frame periods. For convenience, these diagrams show only the polarities of the first column to the fourth column in the direction in which the scanning signal lines extend. Such an arrangement of the polarities of the pixel formation portions 37 on the display screen is referred to as "polarity pattern" and is expressed by polarity diagrams as shown in FIGS. 4A to 4D.

The above-described polarity patterns are set in such a manner that the polarity is inverted at every pixel formation portion 37 in the direction in which the scanning signal lines extend. On the other hand, in the direction in which the video signal lines extend, even though the number of positive polarities may be different from the number of negative polarities, the polarity patterns are typically set for this direction in such a manner that the number of positive polarities is equal to the number of negative polarities.

In this embodiment, one of the first to fourth polarity patterns shown in FIGS. 4A to 4D appears in every frame period. Taking note of the first to fourth frame periods in FIG. 3, the four polarity patterns shown in FIGS. 4A to 4D appear once each in the following order: first pattern, third pattern, second pattern, fourth pattern. In the fifth to eighth frame periods, the polarity patterns appear once each in the following order: third pattern, fourth pattern, second pattern, first pattern. In the ninth to twelfth frame periods, the polarity patterns appear once each in the following order: second pattern, first pattern, fourth pattern, third pattern. In the thirteenth to sixteenth frame periods, the polarity patterns appear once each in the following order: fourth pattern, first pattern, second pattern, third pattern. Thus, the four polarity patterns from the first pattern to the fourth pattern appear once each in every four frame periods, but no regularity can be seen in the order in which the first to fourth patterns appear. Furthermore, the four polarity patterns from the first pattern to the fourth pattern are set such that when the polarity patterns appear once each, then the number of positive polarities and negative polarities that appear is the same for all pixel formation portions 37. It should be noted that the information for generating such polarity patterns is stored in the polarity instruction signal generation circuit 3, as will be described further below. Moreover, the period over which all polarity patterns stored in the polarity instruction signal generation circuit 3 appear once each (that is, four frame periods in the explanations here) is referred to as "polarity equilibrium period" in the following.

Thus, in this embodiment, four different polarity patterns representing the polarities of the pixel formation portions 37 within one block in one frame period are stored. And these four polarity patterns appear once each during one polarity equilibrium period. Moreover, the order in which these polarity patterns appear is different for every polarity equilibrium period. Thus, the polarities of the pixel voltages of each of the pixel formation portions 37 changes irregularly, but within each polarity equilibrium period, the period for which the polarity is positive is the same as the period for which the polarity is negative.

3. Configuration and Operation of the Driving Circuit

The following is a detailed description of the configuration and operation of a driving circuit that generates all of the polarity patterns once each within one polarity equilibrium period and lets these polarity patterns appear in a different order at every polarity equilibrium period.

3.1 Polarity Pattern Table

FIG. 5 is a diagram showing the look-up table 5. In this embodiment, the look-up table 5 stores the information for generating each of the polarity patterns. In FIG. 5, the data shown in each of the rows "00H" to "03H" represent one polarity pattern. Thus, the information that is stored in order to represent one polarity pattern is referred to as "polarity pattern table". For example, the look-up table 5 shown in FIG. 5 stores four polarity pattern tables.

Here, the driving method of the liquid crystal display device according to the present embodiment is dot inversion driving, so that for the pixel voltage of a given row, the polarities of the pixel voltages are inverted column by column within one frame period. Consequently, it is sufficient to store only the information for the polarities of the first column in order to represent one polarity pattern. For example, in order to represent the polarity pattern shown in FIG. 4A, it is sufficient if the information "+, +, −, −" of the polarities of the video signal line SL1 of the first column is stored. Here, as shown in FIG. 5, the information "+, +, −, −" of the polarities is stored as "Bit0" to "Bit3" in the look-up table 5. It should be noted that "Bit0" to "Bit3" in the look-up table 5 store a "1" if the polarity is positive and a "0" if the polarity is negative.

In the present embodiment, in order to generate the four polarity patterns shown in FIGS. 4A to 4D, four polarity pattern tables constituted by four bits each are stored in the look-up table 5, as shown in FIG. 5. Moreover, the look-up table 5 further stores identifiers K for identifying the polarity pattern tables stored in the look-up table 5. For example, in FIG. 5, the polarity pattern table indicating that the polarities of the first row (Bit0) and the third row (Bit2) are positive and the polarities of the second row (Bit1) and the fourth row (Bit4) are negative is specified by the identifier K that is "01H".

3.2 Random Number Generation Circuit

The following is an explanation of the random number generation circuit 4. The random number generation circuit 4 is provided in order to let the polarity patterns based on the polarity pattern tables stored in the above-described look-up table 5 appear once each during one polarity equilibrium period. The random number generation circuit 4 outputs predetermined numbers once each within a predetermined period. There is no regularity in the order in which these numbers are output from the random number generation circuit 4, and also the order in which they are outputted from predetermined period to predetermined period differs.

In this embodiment, the random number generation circuit 4 outputs one of the numbers from 0 to 3 as a random number N. At the point when the random number generation circuit 4 has outputted four random numbers N, all of the numbers from 0 to 3 have been outputted once each. For example, if the number that is outputted first is "2", then the number that is outputted second is "0", "1" or "3", that is, any of the four numbers "0", "1", "2" or "3" but excluding "2". And if the number that is outputted second is "0", then the number that is outputted third is "1" or "3", that is, any of the four numbers "0", "1", "2" or "3" but excluding "0" and "2". In this manner, the numbers from 0 to 3 are outputted once each, but there is no regularity in the order in which those four numbers are outputted.

3.3 Operation of the Polarity Instruction Signal Generation Circuit

The following is an explanation of the operation of the polarity instruction signal generation circuit 3. The polarity instruction signal generation circuit 3 includes the random number generation circuit 4 and the look-up table 5. When the polarity instruction signal generation circuit 3 receives the polarity instruction timing signal REVt, it receives a random number N from the random number generation circuit 4 in synchronization therewith. The random numbers N and the identifiers K of the look-up table 5 are correlated as shown in FIG. 6. When the random number N is outputted, the polarity instruction signal generation circuit 3 selects a polarity pattern table from the look-up table 5 based on the identifier K to which this random number N is correlated. Then, the polarity instruction signal generation circuit 3 obtains the four bits of data of the selected polarity pattern table as the polarity instruction bit data REVd. Furthermore, the polarity instruction signal generation circuit 3 outputs the polarity instruction signal REVs based on the polarity instruction bit data REVd. Then, driving video signals are outputted from the video signal line driving circuit 31 such that voltages with polarities based on this polarity instruction signal REVs are applied to the pixel formation portions 37.

Referring to FIGS. 5 and 6, the following is a description of the operation of the driving circuit for the case that random numbers N are outputted in the order "1, 3, 0, 2" from the random number generation circuit 4 in a given polarity equilibrium period. First, the polarity instruction signal generation circuit 3 receives from the look-up table 5 the polarity instruction bit data REVd based on the identifier K="01H" corresponding to the random number N="1". The polarity instruction bit data REVd are the four bits of data "1010". The polarity instruction signal generation circuit 3 outputs a polarity instruction signal REVs based on these polarity instruction bit data REVd. The video signal line driving circuit 31 outputs driving video signals based on this polarity instruction signal REVs. Thus voltages of polarities based on the polarity pattern tables are applied to each of the pixel formation portions 37 on the display screen, and the voltages of these polarities are held for one frame period. Next, the polarity instruction signal generation circuit 3 receives the polarity instruction bit data REVd from the look-up table 5, based on the identifier K="03H" corresponding to the random number N="3". At this time, the polarity instruction bit data REVd are the four bits of data "0101". As described above, voltages with polarities based on these polarity instruction bit data REVd are applied to the pixel formation portions 37 on the display screen. Moreover, the polarity instruction signal generation circuit 3 operates in a similar manner based on the random number N="0" and the random number N="2", thus completing four frame periods (one polarity equilibrium period).

Figures 7A, 7B:
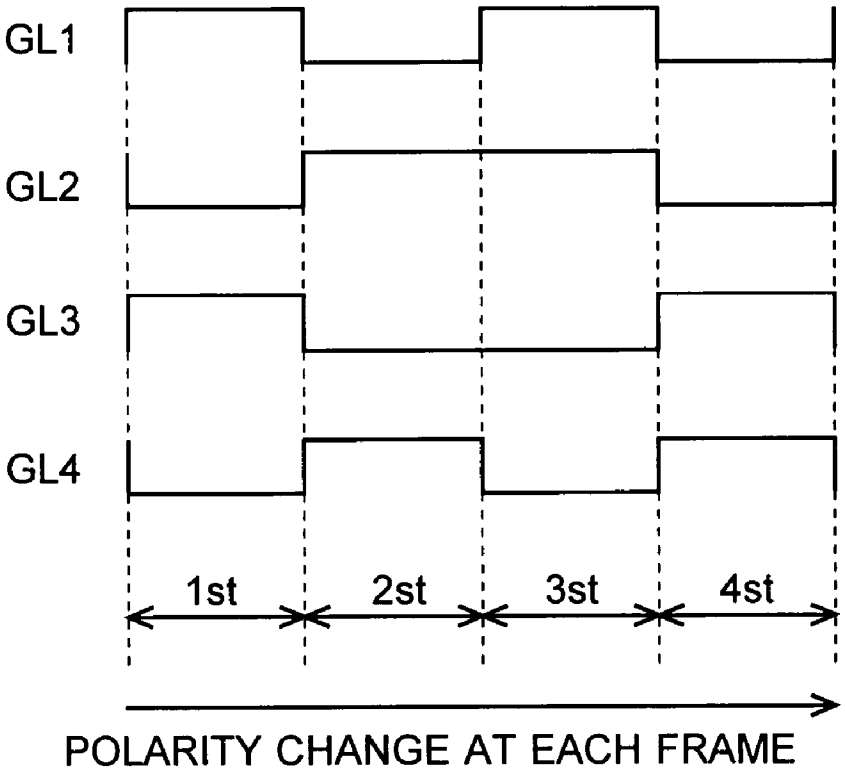
FIG. 7A is a polarity change diagram for one polarity equilibrium period in this embodiment.
FIG. 7B is a signal waveform diagram for one polarity equilibrium period in this embodiment.

FIG. 7A is a polarity change diagram for the above-described one polarity equilibrium period. FIG. 7B is a signal waveform diagram for this one polarity equilibrium period. FIG. 7A shows the polarities of the first to fourth rows, frame period by frame period. FIG. 7B shows the polarities of the first to fourth rows, frame period by frame period, as a signal waveform diagram. FIGS. 8A to 8D are diagrams showing the polarity patterns in each frame period within one polarity equilibrium period. FIG. 8A shows the polarity of the pixel formation portions 37 in the first frame period. FIG. 8B shows the polarity of the pixel formation portions 37 in the second frame period. FIG. 8C shows the polarity of the pixel formation portions 37 in the third frame period. FIG. 8D shows the polarity of the pixel formation portions 37 in the fourth frame period. As shown in FIGS. 8A to 8D, for all of the pixel formation portions 37, the number of frame periods in which the polarity is positive is the same as the number of frame periods in which the polarity is negative.

During operation of the liquid crystal display device 300, the above-described four frame periods (one polarity equilibrium period) are repeated. However, as described above, random numbers N are outputted in irregular order from the random number generation circuit 4, so that the polarity change pattern is different for every polarity equilibrium period.

It should be noted that one polarity equilibrium period is not limited to four frame periods, as long as the look-up table 5 stores different polarity pattern tables of the same number as there are frame periods in one polarity equilibrium period and the look-up table 5 is set such that in each column in the look-up table 5, the number of tables set to positive polarity is the same as the number of tables set to negative polarity. Moreover, in this case, the random number generation circuit 4 should irregularly output the same number of random numbers N as there are polarity pattern tables, as described above.

4. Advantageous Effect

As described above, in the present embodiment, a plurality of polarity pattern tables are stored that represent polarities of the pixel formation portions within one block on the display screen in one frame period. These polarity pattern tables are set such that, for the pixel formation portions within one block, the number of pixel formation portions whose polarity becomes positive is the same as the number of pixel formation portions whose polarity becomes negative. The same polarities as those set for one block are repeated in the direction in which the video signal lines extend on the display screen. One polarity equilibrium period consists of the same number of frame periods as the number of stored polarity pattern tables. In each of the frame periods, the polarity of each of the pixel formation portions is determined based on one of the stored polarity pattern tables. Based on which of the polarity pattern tables the polarity of each of the pixel formation portions is determined depends on the random number that is outputted by the random number generation circuit. Moreover, the same number of random numbers as the number of polarity pattern tables are outputted once each within one polarity equilibrium period by the random number generation circuit. Each of the random numbers is correlated to one of the polarity pattern tables, so that there is no overlap among the random numbers. Furthermore, the order in which the random numbers are outputted by the random number generation circuit is different for every polarity equilibrium period.

Thus, the polarities of the pixel formation portions on the display screen change irregularly temporally as well as spatially. Therefore, the polarity does not become the same for all pixel formation portions displaying a predetermined brightness, and flicker can be suppressed. Moreover, image patterns that are also known as "killer patterns", in which the polarity change patterns of the pixel formation portions are perceived as flicker, do not occur. Furthermore, within a predetermined period, the length of the period in which the polarity is positive is the same as the length of the period in which the polarity is negative, for all pixel formation portions. Therefore, the occurrence of flicker can be suppressed without deterioration of the liquid crystal, and a liquid crystal display device can be provided with which a favorable display quality is attained.

It should be noted that if the size of one block of polarity inversion (number of bits in the polarity pattern table) is large, and if complicated polarity patterns are set within one block, then the above-noted killer patterns cannot be perceived and a favorable display quality can be attained even when the polarity pattern tables are selected regularly.

5. MODIFIED EXAMPLES

5.1 Modified Example 1

In the above-described embodiment, each of the bits of the polarity instruction bit data REVd obtained from the look-up table 5 indicates the polarities of a given row (one scanning signal line), but the present invention is not limited to this. The bits may also indicate the polarities of a plurality of rows. The following is a description of the case that each of the bits of the look-up table 5 shown in FIG. 5 indicates the polarity for two rows. If the random number generation circuit 4 outputs random numbers N in a similar order as in the case shown in FIG. 3 described in the foregoing embodiment, then the polarity change pattern becomes as shown in FIG. 9. In FIG. 9, the polarities in the direction in which the video signal lines extend change such that positive polarities as well as negative polarities are continuous for at least two rows. Thus, with a configuration in which one bit of the polarity instruction bit data REVd represents the polarity of a plurality of rows, it is possible to invert the polarities of the pixel voltage for a plurality of rows together. Thus, insufficient charging of the pixel capacities, which may occur when the polarities of the pixel voltages are inverted at every line, can be prevented, and also the power consumption is reduced.

5.2 Modified Example 2

Moreover, the above-described embodiment was explained for an example of dot inversion driving in which the polarity is inverted at every column, in the direction in which the scanning signal lines extend on the display screen, but the present invention is not limited to this, and can also be applied to line inversion driving. FIGS. 10A to 10D are diagrams showing an example of the order in which polarity patterns are generated in each frame period within one polarity equilibrium period in this modified example. FIG. 10A shows the polarity of the pixel formation portions 37 in the first frame period. FIG. 10B shows the polarity of the pixel formation portions 37 in the second frame period. FIG. 10C shows the polarity of the pixel formation portions 37 in the third frame period. FIG. 10D shows the polarity of the pixel formation portions 37 in the fourth frame period. In FIGS. 10A to 10D, the pixel formation portions 37 extending in the horizontal direction of any given row all have the same polarity. Consequently, if the polarity of the video signal line SL1 of the first column is decided, then also the polarities of the video signal lines SL2 to SL4 of the other columns are decided. Therefore, the configuration of the look-up table 5 and the random numbers N that are outputted from the random number generation circuit 4 may be the same as in the above-described embodiment.

5.3 Modified Example 3

Furthermore, in the above-describe embodiment, in order to ensure that the polarity pattern tables stored in the look-up table 5 are selected once each within per polarity equilibrium period, the random number generation circuit 4 is configured such that a number of different numbers that is the same as the number of polarity pattern tables stored in the look-up table 5 is outputted once each per polarity equilibrium period, but the present invention is not limited to this. FIG. 11 is a diagram showing a look-up table according to this modified example. Compared to the look-up table 5 in FIG. 5, a column denoted "BitR" has been added. When the liquid crystal display device is started up, a "0" is stored in BitR of each of the rows of the look-up table 5 shown in FIG. 11. Then, when a polarity pattern table is selected based on a random number N that is outputted by the random number generation circuit 4, the BitR of the row denoting the selected polarity pattern table in the look-up table 5 is set to "1". When the BitR of all rows in the look-up table 5 are "1", then all BitR are reset to "0". If the BitR of the row indicating the polarity pattern table correlated to the random number N that is outputted by the random number generation circuit 4 is already set to "1", then the polarity instruction bit data REVd is not read in from this polarity pattern table. In this case, when a random number N correlated to a polarity pattern table in which BitR is set to "0"is outputted next, then the polarity instruction bit data REVd are read in from this polarity pattern table. Thus, BitR functions as a flag for identifying which of the polarity pattern tables already have been selected within one polarity equilibrium period. For example, from the look-up table 5 shown in FIG. 11, it can be seen that the polarity pattern table specified by the identifier K="00H" and the polarity pattern table specified by the identifier K="02H" have already been read in a given polarity equilibrium period.

With this configuration, it is also possible that a given random number N is outputted a plurality of times from the random generation circuit 4 within one polarity equilibrium period. Therefore, the circuit configuration of the random number generation circuit 4 becomes simpler. Thus, it is possible to generate an irregular polarity pattern more easily.

While the invention has been described in detail, the foregoing description is in all aspects illustrative and not restrictive. It is understood that numerous other modifications and variations can be devised without departing from the scope of the invention.

What is claimed is:

1. A driving circuit of an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected, the driving circuit comprising:

a polarity instruction circuit for outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative;

a scanning signal line driving circuit for selectively driving the plurality of scanning signal lines; and a video signal line driving circuit for supplying the plurality of video signals generated based on the polarity instruction signal to the plurality of video signal lines, wherein there is no regularity in the order of the occurrence of the polarity of the voltages at the pixel formation portions in each polarity equilibrium period.

2. The driving circuit according to claim 1, wherein the polarity instruction circuit:

comprises different polarity pattern tables indicating, for a plurality of the pixel formation portions respectively corresponding to the intersections of a predetermined number of scanning signal lines and the plurality of video signal lines, whether the polarity of the voltage to be applied is positive or negative, the number of the polarity pattern tables being the same as the number of frame periods included in the polarity equilibrium period;

selects each of the polarity pattern tables once in each polarity equilibrium period, in an irregular order; and generates the polarity instruction signal based on the selected polarity pattern table, so as to determine the polarity of the plurality of pixel formation portions.

3. The driving circuit according to claim 2, wherein the polarity instruction circuit:

further comprises a random number generation circuit for outputting different numbers once each in an irregular order within the polarity equilibrium period, the number of the different numbers being equal to the number of the polarity pattern tables; and selects the polarity pattern table based on the number that is outputted by the random number generation circuit.

4. The driving circuit according to claim 2, wherein the polarity pattern tables are set such that, among the plurality of pixel formation portions, at least two pixel formation portions in which the polarities of the voltages to be applied are the same are consecutive in a direction in which the video signal lines extend.

5. An active matrix liquid crystal display device comprising:

a plurality of video signal lines for transmitting a plurality of video signals representing an image to be displayed, and a plurality of scanning signal lines intersecting the plurality of video signal lines;

a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected;

a polarity instruction circuit for outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative;

a scanning signal line driving circuit for selectively driving the plurality of scanning signal lines; and a video signal line driving circuit for supplying the plurality of video signals generated based on the polarity instruction signal to the plurality of video signal lines, wherein there is no regularity in the order of the occurrence of the polarity of the voltages at the pixel formation portions in each polarity equilibrium period.

6. The display device according to claim 5, wherein the polarity instruction circuit:

comprises different polarity pattern tables indicating, for a plurality of the pixel formation portions respectively corresponding to the intersections of a predetermined number of scanning signal lines and the plurality of video signal lines, whether the polarity of the voltage to be applied is positive or negative, the number of the polarity pattern tables being the same as the number of frame periods included in the polarity equilibrium period;

selects each of the polarity pattern tables once in each polarity equilibrium period, in an irregular order; and generates the polarity instruction signal based on the selected polarity pattern table, so as to determine the polarity of the plurality of pixel formation portions.

7. The display device according to claim 6, wherein the polarity instruction circuit:

further comprises a random number generation circuit for outputting different numbers once each in an irregular order within the polarity equilibrium period, the number of the different numbers being equal to the number of the polarity pattern tables; and selects the polarity pattern table based on the number that is outputted by the random number generation circuit.

8. The display device according to claim 6, wherein the polarity pattern tables are set such that, among the plurality of pixel formation portions, at least two pixel formation portions in which the polarities of the voltages to be applied are the same are consecutive in a direction in which the video signal lines extend.

9. A method for driving an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the respective pixel formation portions being charged with a voltage of the video signal transmitted by the video signal line passing through a corresponding intersection when the scanning signal line passing through the corresponding intersection is selected, the driving method comprising:

a polarity instruction step of outputting a polarity instruction signal indicating polarities of voltages to be applied to the pixel formation portions, such that, in each polarity equilibrium period obtained by grouping together a predetermined number of consecutive frame periods to one polarity equilibrium period, the number of frame periods in which the polarity of the voltage at each of the pixel formation portions becomes positive is the same as the number of frame periods in which the polarity of the voltage at each of the pixel formation portions becomes negative; and a video signal generation step of generating the plurality of video signals generated based on the polarity instruction signal, wherein there is no regularity in the order of the occurrence of the polarity of the voltages at the pixel formation portions in each polarity equilibrium period.

10. The driving method according to claim 9, wherein the polarity instruction step comprises:

a table selection step of selecting, once each in an irregular order within the polarity equilibrium period, different polarity pattern tables indicating, for a plurality of the pixel formation portions respectively corresponding to the intersections of a predetermined number of scanning signal lines and the plurality of video signal lines, whether the polarity of the voltage to be applied is positive or negative, the number of the polarity pattern tables stored being the same as the number of frame periods included in the polarity equilibrium period; and a polarity instruction signal generation step of generating the polarity instruction signal based on the selected polarity pattern table, so as to determine the polarity of the plurality of pixel formation portions.

11. The driving method according to claim 10, wherein the polarity instruction step further comprises:

a random number generation step of outputting different numbers once each in an irregular order within each polarity equilibrium period, the number of the different numbers being equal to the number of the polarity pattern tables; and an identifier reading step of reading an identifier for identifying the polarity pattern table corresponding to the number outputted in the random number generation step;

wherein, in the table selection step, the different polarity pattern tables are selected, based on the identifier, once each in an irregular order within each polarity equilibrium period, the number of the different polarity pattern tables stored in advance being equal to the number of frame periods included in the polarity equilibrium period.

12. The driving method according to claim 10, wherein the polarity instruction step comprises a polarity setting step of setting the polarities such that, among the plurality of pixel formation portions, at least two pixel formation portions in which the polarities of the voltages to be applied are the same are consecutive in a direction in which the video signal lines extend.

* * * * *